US009440818B2

(12) United States Patent
Appana, Jr.

(10) Patent No.: US 9,440,818 B2
(45) Date of Patent: Sep. 13, 2016

(54) ELEVATOR SWING OPERATION SYSTEM AND METHOD

(71) Applicant: ThyssenKrupp Elevator Corporation, Atlanta, GA (US)

(72) Inventor: Amarnauth Eric Appana, Jr., Jamaica, NY (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 436 days.

(21) Appl. No.: 14/157,963

(22) Filed: Jan. 17, 2014

(65) Prior Publication Data

US 2015/0203327 A1 Jul. 23, 2015

(51) Int. Cl.
*B66B 1/20* (2006.01)
*B66B 1/24* (2006.01)

(52) U.S. Cl.
CPC ..... *B66B 1/2458* (2013.01); *B66B 1/2466* (2013.01); *B66B 2201/103* (2013.01); *B66B 2201/214* (2013.01); *B66B 2201/231* (2013.01); *B66B 2201/242* (2013.01)

(58) Field of Classification Search
CPC ..... B66B 1/2458; B66B 1/2466; B66B 2201/103; B66B 2201/214; B66B 2201/231; B66B 2201/242
USPC ..... 187/247, 249, 380–389, 391, 393, 902
See application file for complete search history.

(56) References Cited

U.S. PATENT DOCUMENTS 3,857,465 A 12/1974 Iwasaka et al.
5,024,295 A * 6/1991 Thangavelu ..... B66B 1/2458 187/382
5,092,430 A * 3/1992 Goto ..... B66B 1/16 187/383
5,168,133 A 12/1992 Bahjat et al.
5,272,287 A * 12/1993 Meguerdichian ..... B66B 1/20 187/247
5,300,739 A 4/1994 Bittar
5,317,114 A * 5/1994 Pullela ..... B66B 1/20 187/383
5,460,245 A * 10/1995 Bittar ..... B66B 1/20 187/383
5,480,005 A * 1/1996 Bittar ..... B66B 1/18 187/383
5,511,634 A 4/1996 Bahjat et al.
5,616,896 A 4/1997 Kontturi et al.

(Continued)

FOREIGN PATENT DOCUMENTS

EP 0 662 442 7/1995
GB 2313453 11/1997

OTHER PUBLICATIONS

International Search Report and Written Opinion dated Mar. 30, 2015 for Application No. PCT/US2015/011727.

(Continued)

*Primary Examiner* — Anthony Salata
(74) *Attorney, Agent, or Firm* — Frost Brown Todd LLC

(57) ABSTRACT

An elevator swing operation system for use in a building includes a plurality of floors with landings that are grouped into zones. The elevator cars are allocated to service the zones with a default allocation setup or configuration. The allocation of elevator cars to zones can be modified by moving an elevator car from one zone to another in response to a maximum estimated time to arrival being exceeded and a maximum number of elevator cars allowed to change zones not being exceeded. Furthermore, the default configuration or allocation can be restored when the system is in swing operation, an elevator car is parked, and a minimum time for receiving no calls has been exceeded.

20 Claims, 3 Drawing Sheets

(56) References Cited

U.S. PATENT DOCUMENTS

| | | | | |
|---|---|---|---|---|
| 5,625,176 | A | 4/1997 | Davis et al. | |
| 5,663,538 | A | 9/1997 | Sakita | |
| 5,719,360 | A | 2/1998 | Davis et al. | |
| 5,808,247 | A | 9/1998 | Thangavelu | |
| 5,969,304 | A | 10/1999 | Barker et al. | |
| 6,237,721 | B1 | 5/2001 | Siikonen | |
| 6,991,068 | B2 * | 1/2006 | Siikonen | B66B 1/20 187/247 |
| 7,392,883 | B2 * | 7/2008 | Hikita | B66B 1/2466 187/249 |
| 7,487,861 | B2 * | 2/2009 | LaBarre | B66B 1/18 187/247 |
| 7,841,450 | B2 * | 11/2010 | Smith | B66B 1/18 187/249 |
| 8,151,943 | B2 * | 4/2012 | de Groot | B66B 1/2458 187/382 |
| 8,205,722 | B2 * | 6/2012 | Suihkonen | B66B 1/2458 187/383 |
| 8,960,374 | B2 * | 2/2015 | Nakagawa | B66B 1/2458 187/247 |
| 2009/0057068 | A1 | 3/2009 | Lin et al. | |
| 2009/0133967 | A1 | 5/2009 | Smith et al. | |
| 2012/0090922 | A1 | 4/2012 | Elomaa et al. | |

OTHER PUBLICATIONS

Touch to Go Technologies, elevator touchscreen systems, MAD Elevator Fixtures, elevator touchscreen systems. 2013 product catalog, released Apr. 3, 2013.

* cited by examiner

ELEVATOR SWING OPERATION SYSTEM AND METHOD

BACKGROUND

In the field of elevators, within a building elevator cars can service a designated zone or group of floors with each floor having a corresponding landing. Furthermore, within a building there can be multiple zones. For example, a building could have thirty floors and six elevators. A first zone could be defined as floors 1 through 15 and a second zone could be defined as floors 1 and 16-30. Of the six elevators, three could be designated to service the first zone and the other three could be designated to service the second zone. It can be desirable to have flexibility in assigning and dispatching elevator cars to landings within a building to improve efficiency and reduce elevator wait times for passengers. While there may be devices and methods that control elevator dispatching, it is believed that no one prior to the inventor(s) has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements.

Figure 1:
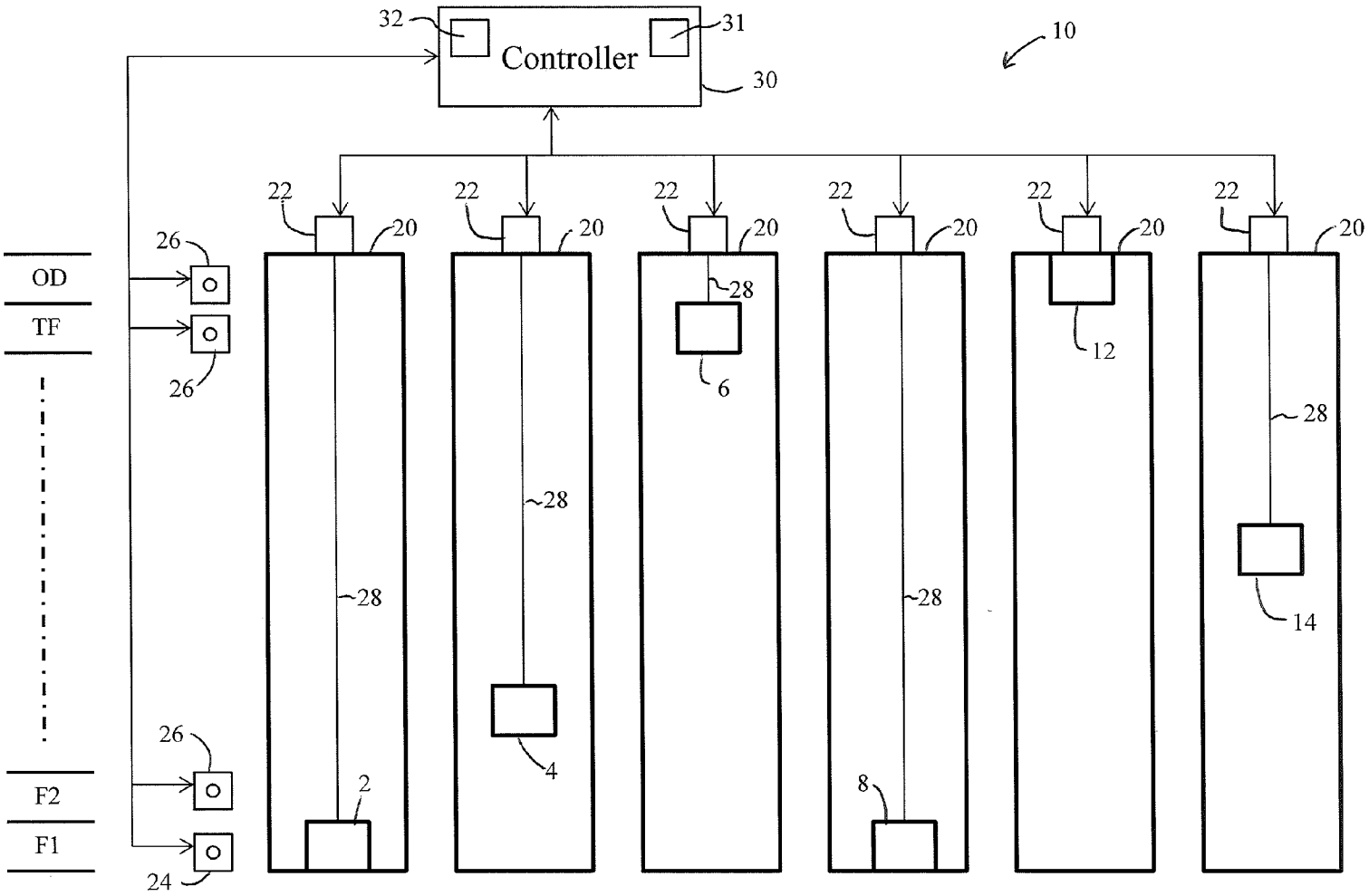
FIG. 1 depicts a schematic view of an exemplary elevator dispatching system configured to dispatch elevator cars to various landings.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

FIG. 1 illustrates an exemplary elevator dispatching system (10) that comprises a plurality of elevator shafts (20). Each elevator shaft (20) comprises an elevator car (2, 4, 6, 8, 12, 14), a drive (22), an optional counterweight (not shown), and a cable (28). Elevator cars (2, 4, 6, 8, 12, 14) are coupled to respective drives (22) by respective cables (28). Each drive (22) is operable to advance and/or retract the associated cable (28) to thereby lower and/or raise respective elevator cars (2, 4, 6, 8, 12, 14) within each respective elevator shaft (20). Accordingly, elevator cars (2, 4, 6, 8, 12, 14) are lowered and/or raised by drives (20) to travel between various landings of various floors within a building. The landings shown in FIG. 1 include a first floor (F1), or lobby, with a second floor (F2) positioned above first floor (F1). Other landings are positioned above second floor (F2) to provide landings through a top floor (TF). An observation deck (OD) is positioned above top floor (TF).

Drives (22) are coupled with a controller (30) that is operable to control drives (22) to dispatch elevator cars (2, 4, 6, 8, 12, 14) to the various landings, as shown in FIG. 1. Controller (30) comprises one or more memories (31) and one or more processors (32). Controller (30) is configured to send and receive various signals from other components of system (10), and controller (30) is configured to execute various processes or steps and/or instructions from processes, for instance processes (50, 70) described further below. Controller (30) is further coupled with elevator call buttons (24, 26). Call button (24) is positioned on first floor (F1) and call buttons (26) are positioned on each landing at and between second floor (F2) and observation deck (OD). A passenger therefore calls an elevator car (2, 4, 6, 8, 12, 14) to the landing where the passenger is located by pressing the corresponding call button (24, 26). For instance, a passenger standing on first floor (F1) presses call button (24) to call an elevator car (2, 4, 6, 8, 12, 14) to first floor (F1). A passenger standing on second floor (F2) presses call button (26) to call an elevator car (2, 4, 6, 8, 12, 14) to second floor (F2), and so on. A signal is sent from call buttons (24, 26) to controller (30), which then assigns an elevator car (2, 4, 6, 8, 12, 14) and controls drives (22) to dispatch the assigned elevator car (2, 4, 6, 8, 12, 14) to the desired floor.

In the present example, elevator dispatching system (10) is of a destination dispatching type. In this type of dispatching system, call button (24), and optionally call buttons (26), comprise selectable features where a passenger inputs their desired destination. The input of the desired destination triggers the call for the elevator as well as informs the system of the passenger's desired destination. With a destination dispatch type system, call buttons (24, 26) are not required to be physical buttons, but can be, for example, a touch-screen with selectable features corresponding to each floor. In other destination dispatch examples, call buttons (24, 26) could comprise a plurality of buttons that correspond to each floor.

In the present example, observation deck (OD) is open to public passengers such that the public passengers travel from first floor (F1) directly to observation deck (OD), but not other floors. In this example, a first zone is thus defined as the first floor (F1) plus the observation deck (OD). Second floor (F2) through and including top floor (TF) are restricted to building passengers such that building passengers travel from first floor (F1) to various floors including and between second floor (F2) and top floor (TF), but not observation deck (OD). So, in this example, a second zone is defined as the first floor (F1) though and including the top floor (TF). It should be understood herein that the term "building passengers" is intended to include those passengers not traveling to the observation deck (OD), while the term "public passengers" is intended to include those passengers traveling to the observation deck.

While each elevator car (2, 4, 6, 8, 12, 14) is capable of serving any floor or the observation deck (OD), elevator cars (2, 4, 6, 8, 12, 14) are grouped, divided, or designated to service either public passengers travelling between first floor (F1) and observation deck (OD) or building passengers travelling between any floor with the exception of the observation deck (OD). It should be understood herein that the term "between" is intended to be inclusive; thus between first floor (F1) and top floor (TF) would include first floor (F1), top floor (TF), and any floor above first floor (F1) and below top floor (TF). Thus elevators (2, 4, 6, 8, 12, 14) are split to service two zones. For instance, in one example, elevator cars (12, 14) are designated for public passengers travelling to observation deck (OD) (or a first zone), while elevator cars (2, 4, 6, 8) are designated for building passengers not traveling to observation deck (OD) (or a second zone).

While elevator cars (2, 4, 6, 8) are designated to the landings between first floor (F1) and top floor (TF) (the second zone) and elevator cars (12, 14) are designated to service first floor (F1) and observation deck (OD) (the first zone), it is desirable under certain conditions to reallocate at least one elevator car (2, 4, 6, 8, 12, 14) such that the at least one elevator car (2, 4, 6, 8, 12, 14) is dispatched to a landing outside of its designated zone of landings. In other words, it can be desirable to reallocate an elevator car designated for the first zone to the second zone and vice versa. For example, an elevator car (2, 4, 6, 8) from the second zone can be reallocated and dispatched to the first zone to service observation deck (OD) instead of the landings of the second zone. Alternatively, an elevator car (12, 14) from the first zone can be reallocated and dispatched to the second zone to service landings between first floor (F1) and top floor (TF) instead of landings of the first zone. Such a reallocation or swing in the dispatching of elevator cars (2, 4, 6, 8, 12, 14) can decrease the amount of time a passenger waits for an elevator car (2, 4, 6, 8, 12, 14) to arrive at the desired landing in response to activating a call button (24, 26). Accordingly, controller (30) includes an algorithm having parameters and steps to reallocate one or more elevator cars (2, 4, 6, 8, 12, 14) between zones, and further to move a reallocated elevator car (2, 4, 6, 8, 12, 14) back to its initial zone under certain conditions.

Figure 2:
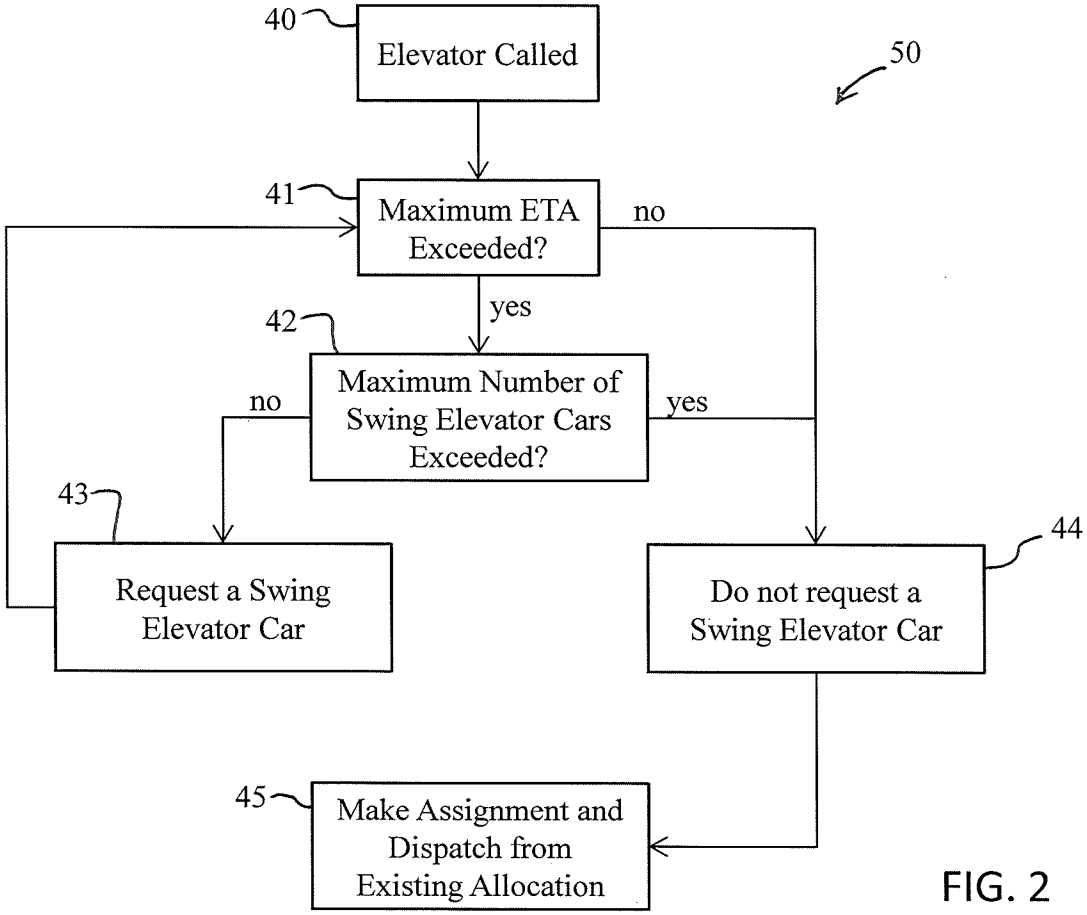
FIG. 2 depicts a flowchart of an exemplary control process to dispatch elevator cars to the various zones within a building.

FIG. 2 illustrates an exemplary elevator dispatching process (50) as part of a control algorithm that can swing elevator cars (2, 4, 6, 8, 12, 14) between zones as described above. In step (40), a passenger calls for an elevator car (2, 4, 6, 8, 12, 14) by pressing or activating a call button (24, 26). In the present example, the passenger indicates the desired landing that the passenger is travelling to at the time the elevator is called. Based on the passenger's selected destination, controller (30) identifies whether the passenger is a building passenger travelling between first floor (F1) and top floor (TF) or the passenger is a public passenger travelling to observation deck (OD). From here, controller (30) then assigns an elevator car from the designated zone to answer the call. In some other versions, other suitable devices and methods may be used to inform controller (30) which zone a passenger or a call is intended for, for example separate elevator buttons, a touch screen, a building passenger badge, among others could be ways for assigning calls or passengers to zones.

In selecting or assigning an elevator car (2, 4, 6, 8, 12, 14) to respond to or answer a call, controller (30) uses parameters of process (50), as shown in FIG. 2. These parameters include the estimated time of arrival (ETA) for an elevator car (2, 4, 6, 8, 12, 14) to reach the floor where the call originated (in this example the first floor (F1)), and the number of elevator cars (2, 4, 6, 8, 12, 14) permitted to be reallocated between zones (also referred to in FIG. 2 as the maximum number of swing elevator cars exceeded).

For instance, where a passenger activates call button (24) at first floor (F1) and selects to travel to top floor (TF), controller (30) selects an elevator car (2, 4, 6, 8, 12, 14) to dispatch to first floor (F1) by first determining whether a maximum ETA is exceeded (41) if the current elevators allocated to service the first zone answer the call. In one example, a maximum ETA is set to 90 seconds such that the threshold is 90 seconds, but other durations can be used in other examples. Accordingly, if the passenger is travelling between first floor (F1) and top floor (TF), controller (30) determines whether a second zone designed elevator car (2, 4, 6, 8) is able to reach first floor (F1) within the ETA, or 90 seconds in this example. If the maximum ETA is not exceeded, controller (30) does not reallocate any first zone elevator cars (12, 14) and dispatches a second zone designated elevator car (2, 4, 6, 8) to first floor (F1) to service the building passenger. Similarly, if the passenger is travelling to observation deck (OD) from first floor (F1), controller (30) determines whether a first zone designed elevator car (12, 14) is able to reach first floor (F1) within the ETA, or 90 seconds. If the maximum ETA is not exceeded, controller (30) does not reallocate any second zone elevator cars (2, 4, 6, 8) and dispatches a first zone designated elevator car (12, 14) to first floor (F1) to service the public passenger.

In the example where the passenger is a building passenger traveling between first floor (F1) and top floor (TF), if the maximum ETA is exceeded by the second zone designated elevator cars (2, 4, 6, 8), controller (30) then determines whether a maximum number of elevator cars permitted to be reallocated is exceeded (42). In the present example, the maximum number of elevator cars permitted to be reallocated can be set to two; in other versions other values can be used—for example, between no elevator cars to all of the elevator cars. If the maximum number of swing elevator cars is exceeded, controller (30) does not request a swing elevator car (44) and dispatches one of the elevator cars presently allocated to that zone. If the maximum number of swing elevator cars is not exceeded, controller (30) requests a swing elevator car (43). For instance, controller (30) swings or reallocates a first zone designated elevator car (12, 14) to the second zone designated elevator car group. In another example where the passenger is a public passenger traveling to the observation deck (OD), controller (30) would swing or reallocate a second zone designated elevator car (2, 4, 6, 8) to the first zone designated elevator car group.

If an elevator car (2, 4, 6, 8, 12, 14) is reallocated, then process (50) returns to the step of determining if the maximum ETA has been exceeded (41) based on the updated allocation which now includes the additional elevator car. Process (50) then repeats until either the maximum ETA is not exceeded (41), or the maximum ETA is exceeded (41) but the maximum number of elevator cars permitted for reallocation or swing (42) is also exceeded. If either one of these conditions are met then controller (30) will not reallocate an elevator car or request a swing elevator car (44), and controller (30) will assign and dispatch one of the elevator cars presently allocated to that zone (45). This ultimate assignment may be based on other parameters that will be apparent to those of ordinary skill in the art in view of the teachings herein.

In some versions of system (10) and process (50), if controller (30) makes a reallocation or swing, and then one of the above assign and dispatch conditions are met, controller (30) will assign and dispatch to the call the elevator car that was reallocated or swung into the zone. In some other versions, it is not necessary or required that the elevator car that was reallocated or swung into the zone is assigned and dispatched to serve the call that prompted the reallocation or swing. Instead, another one of the elevator cars that previously was part of the zone could serve the call that prompted or triggered the reallocation or swing while the car that was reallocated or swung could be assigned and dispatched to serve other calls within the zone. Other ways to assign and dispatch elevator cars to the calls will be apparent to those of ordinary skill in the art in view of the teachings herein.

Figure 3:
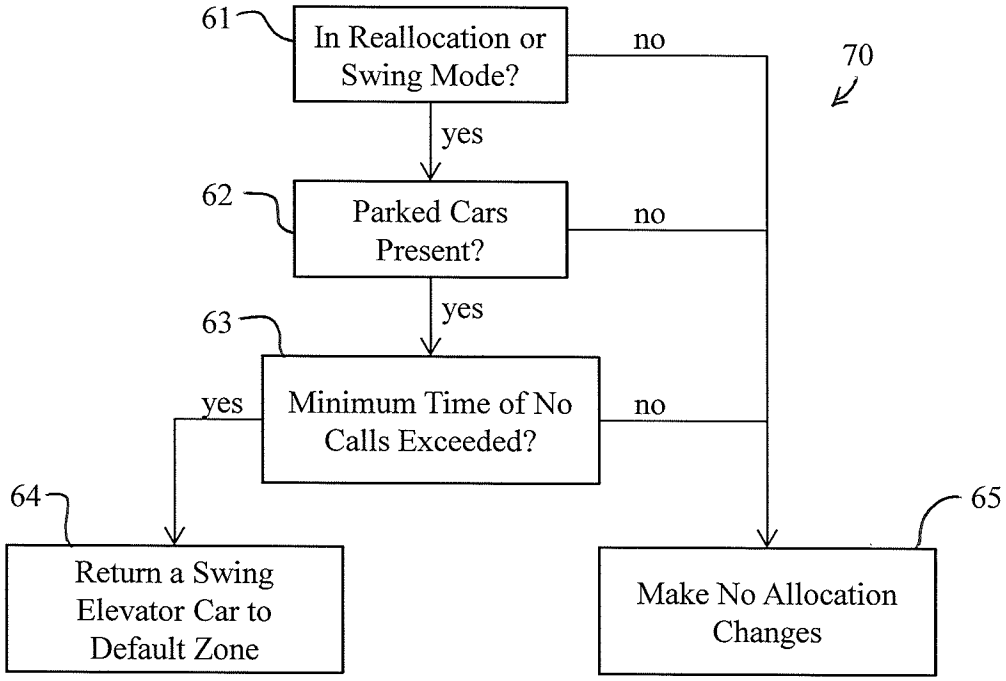
FIG. 3 depicts a flowchart of an exemplary control process to change the allocation of elevator cars servicing different zones within a building.

FIG. 3 illustrates an exemplary elevator control process (70) as part of a control algorithm that can reallocate or swing elevator cars (2, 4, 6, 8, 12, 14) between zones to restore the allocation to a default allocation or setup. In executing process (70), controller (30) uses parameters directed (a) whether or not system (10) is operating in swing mode—this being where there has been some reallocation of one or more elevator cars such that the present allocation differs from a default allocation setting, (b) whether or not an elevator car of a particular zone has been parked, and (c) whether or not a minimum amount of elapsed time has passed where no calls for any of elevator car has been received.

Building upon the example above, elevator cars (12, 14) have a default allocation to a first zone defined by a first floor (F1) and observation deck (OD), and elevator cars (2, 4, 6, 8) have a default allocation to a second zone defined between first floor (F1) and top floor (TF). Because of high traffic from building passengers traveling in the second zone, elevator car (12) has been reallocated based on process (50) from the first zone to the second zone. Under process (70), controller (30) determines whether system (10) is operating in a default mode of allocation or in a swing mode of allocation (61). If operating in default mode then no allocation changes are made (65). In the present example however, system (10) is operating in swing mode because of the prior reallocation of elevator car (12) to the second zone.

After establishing that system (10) is operating in swing mode, controller (30) then determines if there are any parked elevator cars (2, 4, 6, 8, 12) within the second zone operating above its default allocation (62). If there are no such parked elevator cars (2, 4, 6, 8, 12) then no allocation changes are made (65). In the present example however, assume elevator car (4) is parked.

After establishing that system (10) is operating in swing mode (61) and that there is one or more parked cars within the zone operating above its default allocation (62), controller (30) then determines if a minimum time has elapsed or passed for receiving no calls for an elevator car within the zone operating above its default allocation (63). If this minimum amount of time is not exceeded, controller (30) keeps the allocation the same (65). If this minimum amount of time has been exceeded, controller (30) returns an elevator car—elevator car (12) in the present example—back to its originally designated zone or default allocation (64). In some versions of process (70) when controller (30) switches an elevator car under process (70), the elevator car that is switched is the one of the elevator cars that was originally reallocated or swung into the zone in question based on process (50). In such a version, this means that it is not necessarily the parked elevator car that is the elevator car moved back toward the default allocation. In some other versions of process (70) the elevator car that is switched is one of the elevator cars other than one that was originally reallocated or swung into the zone in question based on process (50). Again, the elevator car that is parked is not necessarily the elevator car that is moved back toward the default allocation, although in some instances it can be.

As a result of controller (30) swinging elevator cars (2, 4, 6, 8, 12, 14) to assign and dispatch to landings or zones outside of the designated landings or zones, elevator cars (2, 4, 6, 8, 12, 14) in system (10) arrive to service passenger calls in a decreased amount of time to lower passenger wait times. For instance, in one example where just a single elevator car was added to a group of a zone to assist with traffic a 14.1 second improvement was observed in the average time to destination; a 7.9 second improvement was observed in dispatch interval time from the lobby; and an 8.8 second improvement was observed on the average wait time experienced by passengers.

Although the present example describes elevator cars (2, 4, 6, 8) as being designated for the building passengers and elevator cars (12, 14) as being designated for the public passengers, controller (30) can designate any elevator car (2, 4, 6, 8, 12, 14) to service either building passengers and/or public passengers. In some versions, a specific elevator car (2, 4, 6, 8, 12, 14) and/or amount of elevator cars (2, 4, 6, 8, 12, 14) are permanently assigned to designated landings such that elevator cars (2, 4, 6, 8, 12, 14) are unable to switch outside of the designated landings. In some other versions, a specific elevator car (2, 4, 6, 8, 12, 14) and/or amount of elevator cars (2, 4, 6, 8, 12, 14) are assigned to be switching elevator cars such that only the assigned elevator cars (2, 4, 6, 8, 12, 14) are able to switch outside of its designated landings. For instance, elevator cars (2, 4) can be designated to only service the public passengers, elevator cars (12, 14) can be designated to only service building passengers, and/or elevator cars (6, 8) can be designated to switch between building and public passengers. Also, the parameters in process (50) are adjustable. For example, a user can adjust the values for the maximum ETA, the number of swing elevator cars, and/or the minimum amount of time that an elevator car receives no calls.

In some versions, the building does not have an observation deck (OD) or public passengers that access only a single floor. Instead, the building contains multiple zones with elevator cars that service the passengers to floors within the respective zones. For example, the building can have a high-rise zone, a mid-rise zone, and/or a low-rise zone, each accessible from a lobby floor. Controller (30) can designate and switch elevator cars between various landings and/or zones within the building using processes (50, 70).

In some instances, observation deck (OD) has restricted hours of access compared to the landings between first floor (F1) and top floor (TF). Knowing the time of day, controller (30) can therefore be configured to control swing operation to under more stringent parameters during times where it is known that elevator cars for another zone will not be used. For instance, during times when observation deck (OD) is closed and, elevator cars (12, 14), for example, are available. As such, controller (30) can be configured such that the maximum ETA parameter is set lower during this time to trigger swing operation such that passenger service is further improved by reducing wait times. Once observation deck (OD) is open, the maximum ETA parameter can be automatically reset to a default or another setting. Other suitable configurations for controller (30) and/or processes (50, 70) will be apparent to one with ordinary skill in the art in view of the teachings herein.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

I claim:

1. An elevator dispatching system for use in a building having a plurality of service areas, a plurality of elevator cars, and an elevator controller, wherein the elevator dispatching system comprises:

a. a first parameter defining a maximum estimated time to arrival (ETA);

b. a second parameter defining a maximum number of the plurality of elevator cars allowed to change between the plurality of service areas; and c. a third parameter defining a minimum time for receiving no calls for one or more elevator cars of the plurality of elevator cars;

d. wherein a first set of the plurality of elevator cars is designated to service a first service area of the plurality of service areas;

e. wherein a second set of the plurality of elevator cars is designated to service a second service area of the plurality of service areas; and f. wherein an elevator car from the first set of the plurality of elevator cars is switched to service the second service area in response to the maximum ETA, and the maximum number of the plurality of elevator cars allowed to change between the plurality of service areas.

2. The system of claim 1, wherein the elevator car from the first set of the plurality of elevator cars is switched to service the second service area when the maximum ETA is exceeded.

3. The system of claim 1, wherein the elevator car from the first set of the plurality of elevator cars continues to service the first service area when the maximum ETA is not exceeded.

4. The system of claim 1, wherein the elevator car from the first set of the plurality of elevator cars is switched to service the second service area when the maximum number of the plurality of elevator cars allowed to change is not exceeded.

5. The system of claim 1, wherein the elevator car from the first set of the plurality of elevator cars is switched to service the second service area when the maximum ETA is exceeded and the maximum number of the plurality of elevator cars allowed to change is not exceeded.

6. The system of claim 5, wherein a second elevator car from the first set of the plurality of elevator cars is switched to service the second service area when the maximum ETA is exceeded and the maximum number of the plurality of elevator cars allowed to change is not exceeded.

7. The system of claim 1, wherein the elevator car from the first set of the plurality of elevator cars continues to service the first service area when the maximum number of the plurality of elevator cars allowed to change is exceeded.

8. The system of claim 1, wherein the elevator car from the first set of the plurality of elevator cars that was switched to service the second service area is returned to service the first service area when the minimum time for receiving no calls is exceeded.

9. The system of claim 1, wherein the elevator car from the first set of the plurality of elevator cars that was switched to service the second service area continues to service the second service area when the minimum time for receiving no calls is not exceeded.

10. The system of claim 1, wherein any of the plurality of elevator cars can service any of the plurality of service areas.

11. The system of claim 1, wherein the first service area includes an observation deck.

12. The system of claim 11, wherein the second service area includes a private building service area.

13. The system of claim 1, wherein the building comprises a plurality of floors, wherein each floor comprises a feature to call the elevator car from the plurality of elevator cars.

14. The system of claim 13, wherein the feature is coupled with the controller, wherein the feature is operable to communicate to the controller the desired destination of a passenger.

15. The system of claim 1, wherein the system is operable to lower an average wait time of a passenger.

16. An elevator dispatching system for use in a building having a plurality of service areas, a plurality of elevator cars, and an elevator controller, wherein the elevator dispatching system comprises:

a. a first parameter defining a maximum estimated time to arrival (ETA);

b. a second parameter defining a maximum number of the plurality of elevator cars allowed to change between the plurality of service areas; and c. a third parameter defining a minimum time for receiving no calls for an elevator car of the plurality of elevator cars;

d. wherein a first set of the plurality of elevator cars is designated to service a first service area of the plurality of service areas;

e. wherein a second set of the plurality of elevator cars is designated to service a second service area of the plurality of service areas;

f. wherein an elevator car from the first set of the plurality of elevator cars is switched to service the second service area in response to the maximum ETA being exceeded and the maximum number of the plurality of elevator cars allowed to change between the plurality of service areas not being exceeded; and g. wherein the elevator car from the first set that was switched is returned to service the first service area in response to the minimum time for receiving no calls being exceeded.

17. The elevator dispatching system of claim 16, wherein the elevator car from the first set that was switched is returned to service the first service area in further response to an elevator car from the second set being parked.

18. A method for dispatching an elevator car to a landing, wherein the method comprises:

a. designating a first set of elevator cars to service a first zone;

b. designating a second set of elevator cars to service a second zone;

c. switching an elevator car from the first set of elevator cars to service the second zone when a maximum estimated time to arrival (ETA) is exceeded and a maximum number of the plurality of elevator cars allowed to change zones is not exceeded.

19. The method of claim 18, further comprising returning the switched elevator car to the first zone when a minimum time for receiving no calls is exceeded within the second zone.

20. The method of claim 18, wherein another elevator car from the first set elevator cars designated to service the first zone is switched to service the second zone until the maximum number of the elevator cars allowed to change between zones is reached.

* * * * *